US009309828B2

(12) United States Patent
Nagao et al.

(10) Patent No.: US 9,309,828 B2
(45) Date of Patent: Apr. 12, 2016

(54) FUEL SUPPLY APPARATUS

(71) Applicant: DENSO CORPORATION, Kariya, Aichi-pref. (JP)

(72) Inventors: Takeru Nagao, Kariya (JP); Ken Uchiyama, Toyoake (JP)

(73) Assignee: DENSO CORPORATION, Kariya (JP)

( * ) Notice: Subject to any disclaimer, the term of this patent is extended or adjusted under 35 U.S.C. 154(b) by 195 days.

(21) Appl. No.: 14/171,856

(22) Filed: Feb. 4, 2014

(65) Prior Publication Data

US 2014/0216408 A1 Aug. 7, 2014

(30) Foreign Application Priority Data

Feb. 5, 2013 (JP) ..... 2013-020021

(51) Int. Cl.

| | |
|---|---|
| ***F02M 37/08*** | (2006.01) |
| ***F02D 41/38*** | (2006.01) |
| ***F02M 63/02*** | (2006.01) |
| *F02D 41/06* | (2006.01) |
| *F02D 41/14* | (2006.01) |

(52) U.S. Cl.

CPC ..... *F02D 41/3845* (2013.01); *F02D 41/3863* (2013.01); *F02M 63/025* (2013.01); *F02D 41/062* (2013.01); *F02D 2041/1409* (2013.01); *F02D 2200/0602* (2013.01)

(58) Field of Classification Search

CPC ..... F02D 41/3845; F02D 41/062; F02D 41/3082; F02D 41/3863; F02D 2041/1409; F02D 2200/0602; F02M 63/025; F02M 63/0015; F02M 37/08; F02M 2037/087; F02M 51/04; F02M 57/027

USPC ..... 123/446, 457, 458, 459, 456, 497, 498, 123/499, 510, 511, 491; 701/103, 113; 73/114.41, 114.42, 114.43

See application file for complete search history.

(56) References Cited

U.S. PATENT DOCUMENTS

| | | | | |
|---|---|---|---|---|
| 8,573,185 | B2 * | 11/2013 | Miura | F02D 41/22 123/198 D |
| 2005/0103312 | A1 * | 5/2005 | Uchiyama | F02D 41/221 123/457 |

FOREIGN PATENT DOCUMENTS

| | | | | |
|---|---|---|---|---|
| EP | 1 441 118 | A2 * | 7/2004 | F02D 41/04 |
| EP | 1 529 940 | A2 * | 5/2005 | F02D 1/00 |
| JP | 2001-082230 | | 3/2001 | |
| JP | 2005-139975 | | 6/2005 | |
| JP | 2010-261335 | | 11/2010 | |

OTHER PUBLICATIONS

Office Action (2 pages) dated Sep. 15, 2015, issued in corresponding Japanese Application No. 2013-020021 and English translation (3 pages).

* cited by examiner

*Primary Examiner* — Hai Huynh

(74) *Attorney, Agent, or Firm* — Nixon & Vanderhye PC

(57) ABSTRACT

In the start mode of a fuel supply apparatus, a subtraction value of an electric power is obtained in view of an SCV characteristic. Furthermore, a common correction value is employed as the subtraction value in order to increase an actual fuel discharge amount when the internal combustion engine is started, whereby a fuel pressure in an accumulator agrees with the target value even if an individual pump unit shows a lowest limit in the variations of the discharge amount. The common correction value is shared among the individual pump units. Even if a starting characteristic is not acquired for each of the individual supply pumps, the internal combustion engine can reliably be started.

4 Claims, 7 Drawing Sheets

FUEL SUPPLY APPARATUS

CROSS-REFERENCE TO RELATED APPLICATION

This application is based on Japanese Patent Application No. 2013-20021 filed on Feb. 5, 2013, the disclosure of which is incorporated herein by reference.

TECHNICAL FIELD

The present disclosure relates to a fuel supply apparatus configured to supply a fuel to an internal combustion engine through an accumulator in which the fuel of high pressure is accumulated.

BACKGROUND

As shown in JP-2001-082230A, an accumulator-type fuel supply apparatus is employed for injecting a fuel into a combustion chamber of a direct-injection engine such as a diesel engine. The fuel supply apparatus includes a pump unit and an electronic control unit (ECU) as described below.

The pump unit includes a high-pressure pump which suctions the fuel, pressurizes the fuel, and discharges the fuel into the accumulator. An amount adjusting unit adjusts the amount of fuel that the high-pressure pump suctions. Further, the amount adjusting unit increases or decreases the fuel amount that the high-pressure pump suctions in accordance with an amount of electric power supplied to the amount adjusting unit. Also, the amount adjusting unit adjusts the fuel amount that the high-pressure pump discharges.

The amount adjusting unit has control characteristics, which are stored in the ECU. The control characteristics are used for controlling the electric power supplied to the amount adjusting unit. The control characteristics indicate a correlation between the amount of electric power and a discharge amount of the high-pressure pump. The ECU operates the amount adjusting unit to control a fuel pressure in the accumulator. The fuel pressure in the accumulator corresponds to a fuel injection pressure into the combustion chamber. More specifically, the ECU calculates a requesting value required for bringing the fuel pressure in the accumulator to substantially agree with a target value. Then, in view of the control characteristic, the ECU calculates a target amount of electric power.

A fuel injector is mounted on each cylinder of the internal combustion engine. The ECU controls an injection timing and an injection period, so that the fuel amount injected into the combustion chamber agrees with a target fuel amount.

The fuel supply apparatus needs to fill the accumulator with the fuel at the time of starting the internal combustion engine. Therefore, the control characteristic of the pump units (hereinafter, referred to as master characteristic), which is corrected for starting the engine, is memorized in the ECU. For example, when assembling the fuel supply apparatus to a vehicle, a test is conducted so that an engine speed, a fuel pressure in the accumulator, a fuel injection amount and the like satisfy the conditions for starting the fuel supply apparatus. Therefore, the master characteristic is corrected on the basis of the result of the test, and the corrected control characteristic is stored in the ECU as a starting characteristic specific for individual pump unit.

However, the starting characteristics need to obtain for each of the individual pump units, and hence a tact time in a factory is obliged to increase. The starting characteristics of the pump units need to be acquired again and memorized again at the time of replacement of the pump unit in the market as well.

SUMMARY

It is an object of the present disclosure to provide a fuel supply apparatus which reliably starts an internal combustion engine without individually obtaining a starting characteristic of pump units.

According to an aspect of the present disclosure, a fuel supply apparatus supplies fuel to an internal combustion engine via an accumulator in which fuel is accumulated at a high pressure. The fuel supply apparatus includes a pump unit, and a control unit.

The pump unit includes a high-pressure pump and an amount adjusting portion which adjusts the amount of fuel that the high-pressure pump suctions. The amount adjusting portion adjusts an amount of fuel discharge by the high-pressure pump.

The control unit stores a control characteristic which indicates a correlation between the amount of electric power and a discharge amount of the pump unit.

Also, the control unit calculates a requesting discharge amount for bringing the fuel pressure in the accumulator container to substantially agree with a target value. The requesting discharge amount is applied to the control characteristics to obtain a target electric power.

A starting mode is executed by the control unit at the time of starting the internal combustion engine. In the starting mode, the requesting discharge amount is calculated, and a target electric power which is larger or smaller than a formal target electric power is obtained by applying the requesting discharge amount to the control characteristics. An actual discharge amount is increased.

Furthermore, the final target electric power is computed by using of a common correction value so that the fuel pressure in the accumulator substantially agrees with the target fuel pressure even if the pump unit individually shows a largest variation of the discharge amount. A common correction value is established when calculating the final target electric power value in the starting mode. The common correction value is set as a value which can increase an actual discharge amount of the pump unit and bring the fuel pressure in the accumulator to substantially agree with the target value.

Accordingly, even an individual pump unit showing a lowest limit of the variations in discharge amount among the individual pump units of the same type is capable of filling the accumulator container reliably with fuel and accumulating the same therein at the time of starting the internal combustion engine, thereby bringing a fuel pressure in the accumulator to substantially agree with the target value. Therefore, even though the pump unit is the lowest amount-of-discharge unit, an amount of fuel injection required for starting the internal combustion engine is reliably injected and supplied to the combustion chamber.

With the configuration described above in the accumulator-type fuel supply apparatus, even though the starting characteristics are not acquired for each of the individual pump unit, the internal combustion engine can reliably be started.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Referring to drawings, an embodiment of the present disclosure will be described hereinafter.

[Configuration]

A general configuration of a fuel supply apparatus 1 will be described with reference to the drawings.

Figure 1:
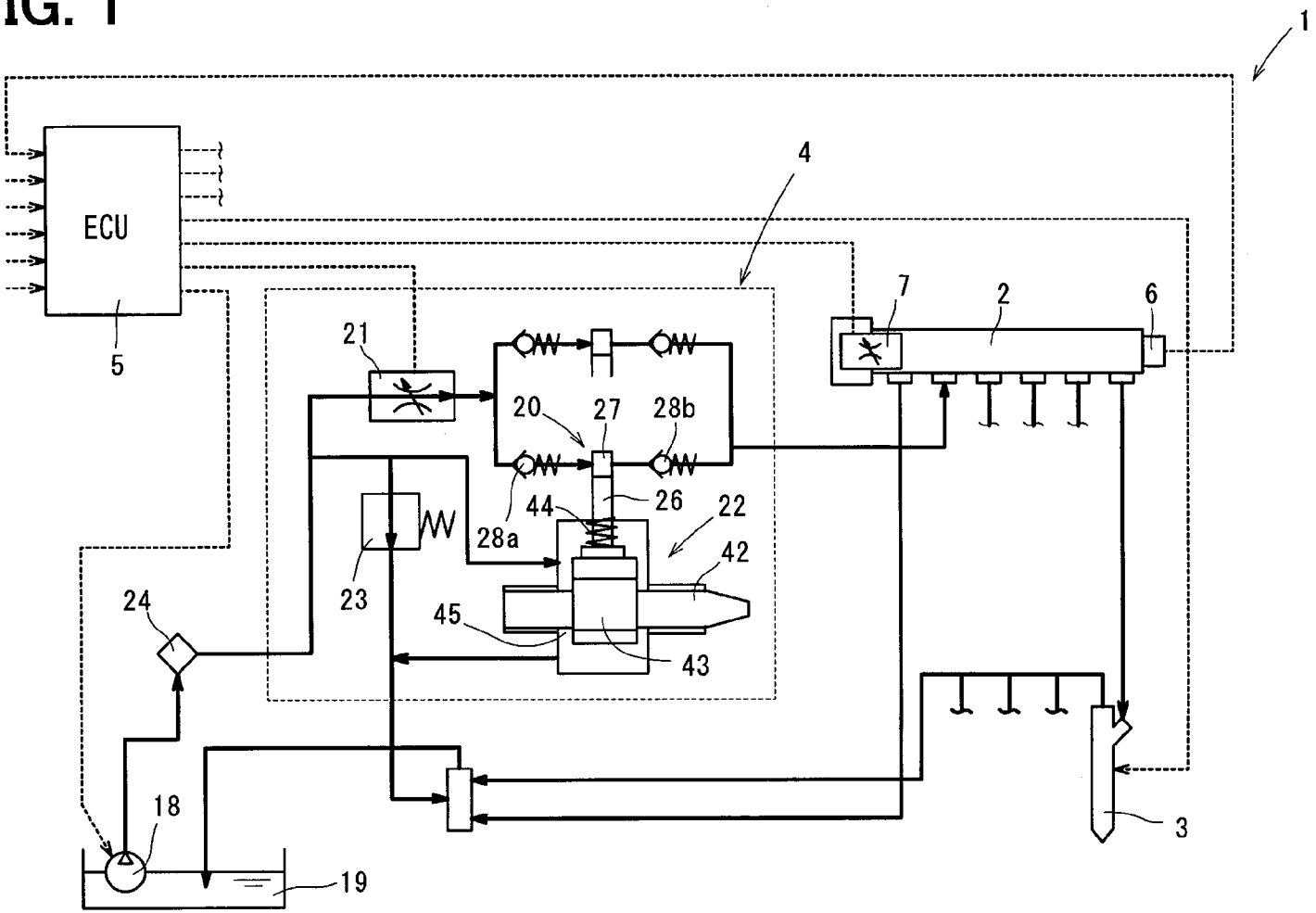
FIG. 1 is a general configuration drawing illustrating a fuel supply apparatus.
Figure 2:
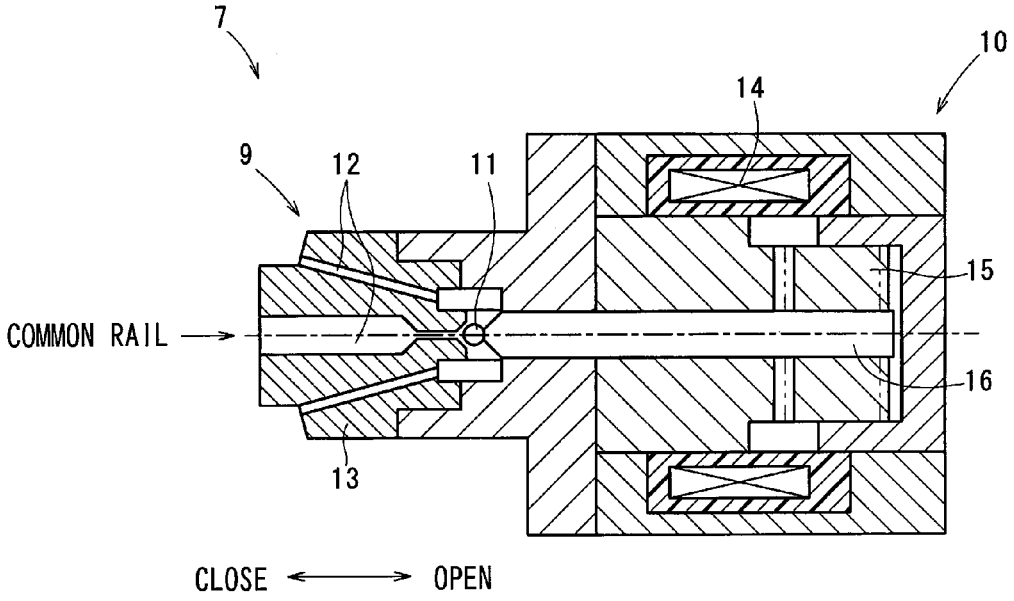
FIG. 2 is a configuration drawing illustrating a relief valve.
Figure 3:
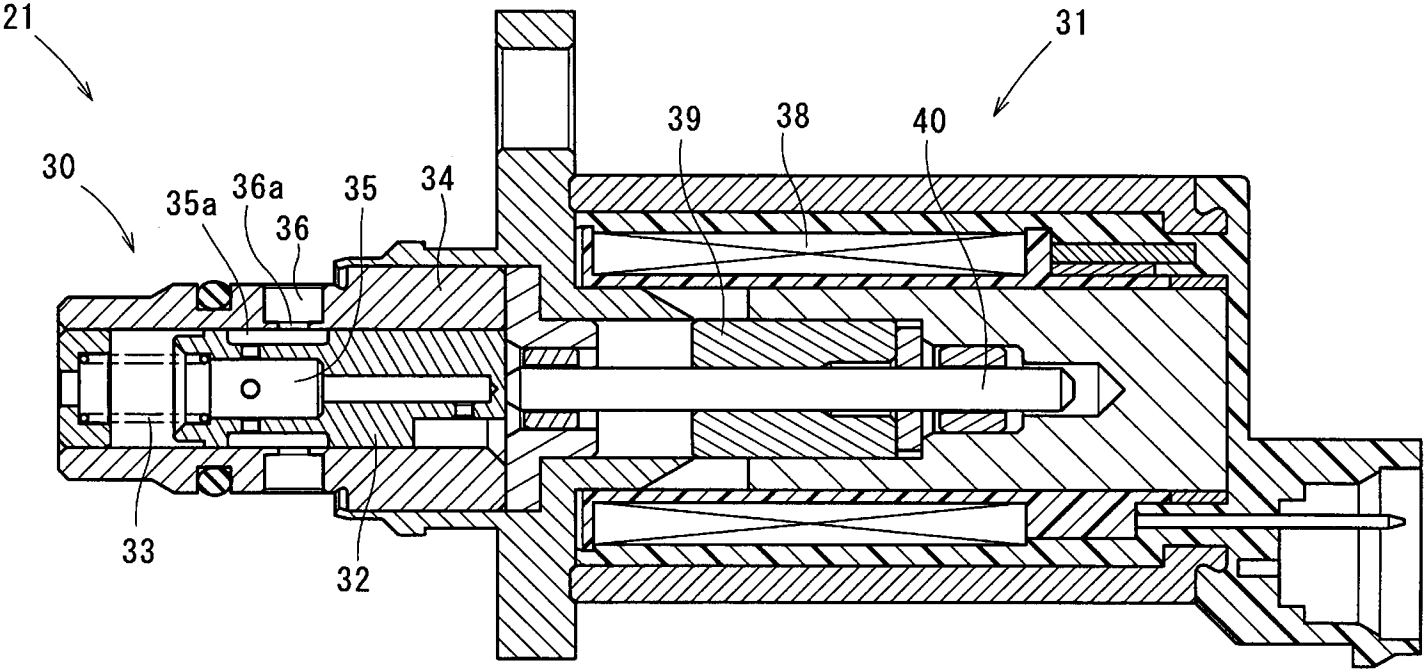
FIG. 3 is a configuration drawing illustrating an intake amount adjusting valve.

Referring now to FIG. 1 to FIG. 3, the general configuration of the fuel supply apparatus 1 will be described.

The fuel supply apparatus 1 includes a common rail (accumulator) 2, a fuel injector 3, a pump unit which is referred to as a supply pump 4, and an electronic control unit (ECU) 5.

The common rail 2 accumulates a high pressure fuel discharged from the supply pump 4. The common rail 2 also distributes the high-pressure fuel to the fuel injector 3. A fuel pressure (rail pressure) in the common rail 2 corresponds to an injection pressure of fuel by the fuel injector 3. The rail pressure "RP" is detected by a rail pressure sensor 6. The detected rail pressure is transmitted to the ECU 5. Furthermore, the common rail 2 is provided with a relief valve 7. An operation of the relief valve 7 is controlled by the ECU 5 in such a manner that the relief valve 7 opens when the rail pressure needs to be reduced quickly.

The relief valve 7 is configured to release the fuel from the common rail 2, and includes mainly a valve unit 9 and a solenoid unit 10 as illustrated in FIG. 2.

The valve unit 9 includes a spherical valve body 11 driven by the solenoid unit 10, and a housing 13 accommodating the valve body 11. The housing 13 defines a flow channel 12 configured to be opened and closed by the valve body 11. The valve body 11 is urged in an opening direction by the fuel flowing from the common rail 2. The solenoid unit 10 drives the valve body 11 in a closing direction against a fuel pressure that corresponds to the rail pressure.

The solenoid unit 10 includes a coil 14 generating a magnetic flux by energization, a movable iron core 15 driven in the closing direction by the magnetic flux, and an output shaft 16 integrated with the movable iron core 15. The movable iron core 15 is attracted in the closing direction in accordance with an amount of electric power supplied to the coil 14, whereby the valve body 11 is closed.

The relief valve 7 is a normally-opened type valve which reduces a relief fuel amount "qRE" from the common rail 2 in accordance with increase in the amount of electric power supplied to the coil 14. When the amount of electric power to the coil 14 is zero, the relief fuel amount "qRE" becomes the maximum. The relief fuel amount "qRE" is reduced with an increase in the amount of electric power supplied to the coil 14. The amount of electric power to the coil 14 is controlled by the ECU 5.

The fuel injector 3 is mounted on respective cylinders of the internal combustion engine and injects the fuel into combustion chambers. The ECU 5 controls an injection timing and an injection period, so that the amount of the fuel injected into the combustion chamber agrees with a target injection amount.

The supply pump 4 pressurizes the fuel pumped up from a fuel tank 19 by a feed pump 18. Then, the supply pump 4 discharges the high-pressure fuel to the common rail 2. The supply pump 4 has a high-pressure pump 20, a suction control valve (amount adjusting portion) 21, a drive unit 22, and a pressure adjusting valve 23 described below. The feed pump 18 is an electric pump controlled by the ECU 5. A fuel filter 24 is provided between the supply pump 4 and the feed pump 18.

The high-pressure pump 20 suctions and pressurizes the fuel. The pressurized fuel is discharged to the common rail 2. The high-pressure pump 20 has a compression chamber 27 and a plunger 26. A suction check valve **28*a* is disposed at a suction port (not shown) of the compression chamber 27. A discharge check valve 28*b* is disposed at a discharge (not shown) of the compression chamber 27**.

The suction control valve 21 adjusts the amount of fuel which is suctioned by the high-pressure pump 20, so that the discharge fuel amount of the supply pump 4 is controlled. The suction control valve 21 is provided between the high-pressure pump 20 and the fuel filter 24. As illustrated in FIG. 3, the suction control valve 21 includes mainly a valve unit 30 and a solenoid unit 31.

The valve unit 30 includes a valve body 32 which is drove in an axial direction by the solenoid unit 31 and a spring 33. A housing 34 accommodates the valve body 32 and the spring 33, and the like. The flow amount of fuel passing through the valve unit 30 is determined by an extent of overlap between an opening **35*a* of a flow channel 35 provided in the valve body 32 and an opening 36*a* of a flow channel 36 provided in the housing 34. When the attracting force of the solenoid unit 31 and the urging force of the spring 33 are countervailed, the position of the valve body 32 is fixed so that the amount of the fuel flowing toward the high-pressure pump 20 through the suction control valve 21 is fixed. Consequently, the suction amount of the high-pressure pump 20 is fixed and the discharge amount of the supply pump 4** is fixed.

The solenoid unit 31 includes a coil 38 generating a magnetic flux, a movable iron core 39 configured to be driven in the axial direction by the magnetic flux, and an output shaft 40 integrated with the movable iron core 39. The output shaft 40 can come into contact with the valve body 32 in the axial direction. The movable iron core 39 is attracted in the axial direction in accordance with the amount of electric power supplied to the coil 38.

The amount of overlap between the openings **35*a*, 36*a* of the valve unit 30 is maximized when the amount of electric power to the coil 38 is zero. The amount of overlap between the openings 35*a*, 36*a* is reduced in association with an increase in the amount of electric power. The suction control valve 21 is a normally-open type valve which reduces the flow amount of fuel passing therethrough in association with an increase in the amount of electric power. The amount of electric power to the coil 38 is operated by the ECU 5**.

The drive unit 22, for example, includes a drive shaft 42 driven by the internal combustion engine, a cam 43 integrated with the drive shaft 42, and a spring 44 biasing the plunger 26 in a direction opposite to the direction driven by the cam 43. The fuel discharged from the feed pump 18 is supplied as a lubricant to the cam chamber 45.

The pressure adjusting valve 23 controls the discharging pressure of the feed pump 18 to a predetermined control value.

The ECU 5 includes a microcomputer (not illustrated) having a CPU configured to perform control processing and arithmetic processing, a memory device such as a ROM and a RAM, an input device, and an output device. The ECU 5 performs control and arithmetic processing based on detection signals from various sensors such as the rail pressure sensor 6. Also, the ECU 5 outputs a command signal for energizing the relief valve 7 and the suction control valve 21.

Subsequently, the configuration of the fuel supply apparatus 1 will be described more in detail.

The fuel supply apparatus 1 has the relief valve 7, the supply pump 4 and the ECU 5, and the suction control valve 21. The ECU 5 stores a control characteristic of the suction control valve 21, which is referred to as SCV characteristic. Further, the ECU 5 stores a common correction value "CV" for a starting mode of the fuel supply apparatus 1.

Figure 4:
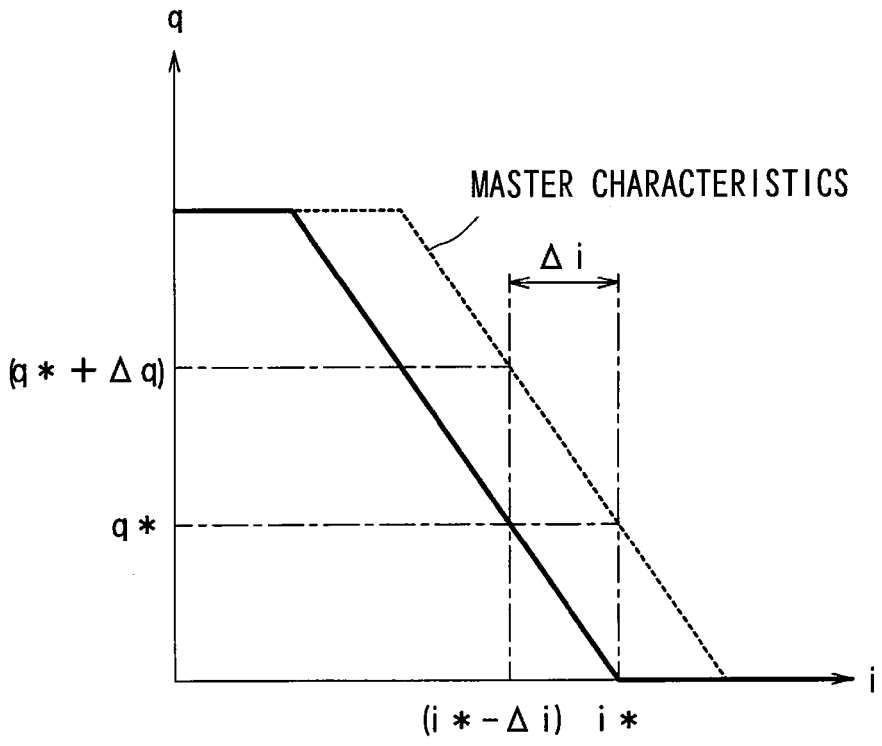
FIG. 4 is a block flowchart illustrating control of a rail pressure performed by a supply pump.

The SCV characteristics indicate a correlation between the amount of electric power "i" supplied to the coil 38 and a discharge amount "q" of the supply pump 4 as illustrated in FIG. 4. Since the suction control valve 21 is a normally-open type, the SVC characteristic has a linear characteristic in which the discharge amount "q" is linearly reduced with an increase of the amount of electric power "i". The SVC characteristic is stored in the ECU 5 as the master characteristic of the supply pump 4. The discharge amount "q" of the supply pump 4 of the same type supply pump is adjusted on the basis of the same SCV characteristics which are not different among the individual supply pumps 4.

Figure 5:
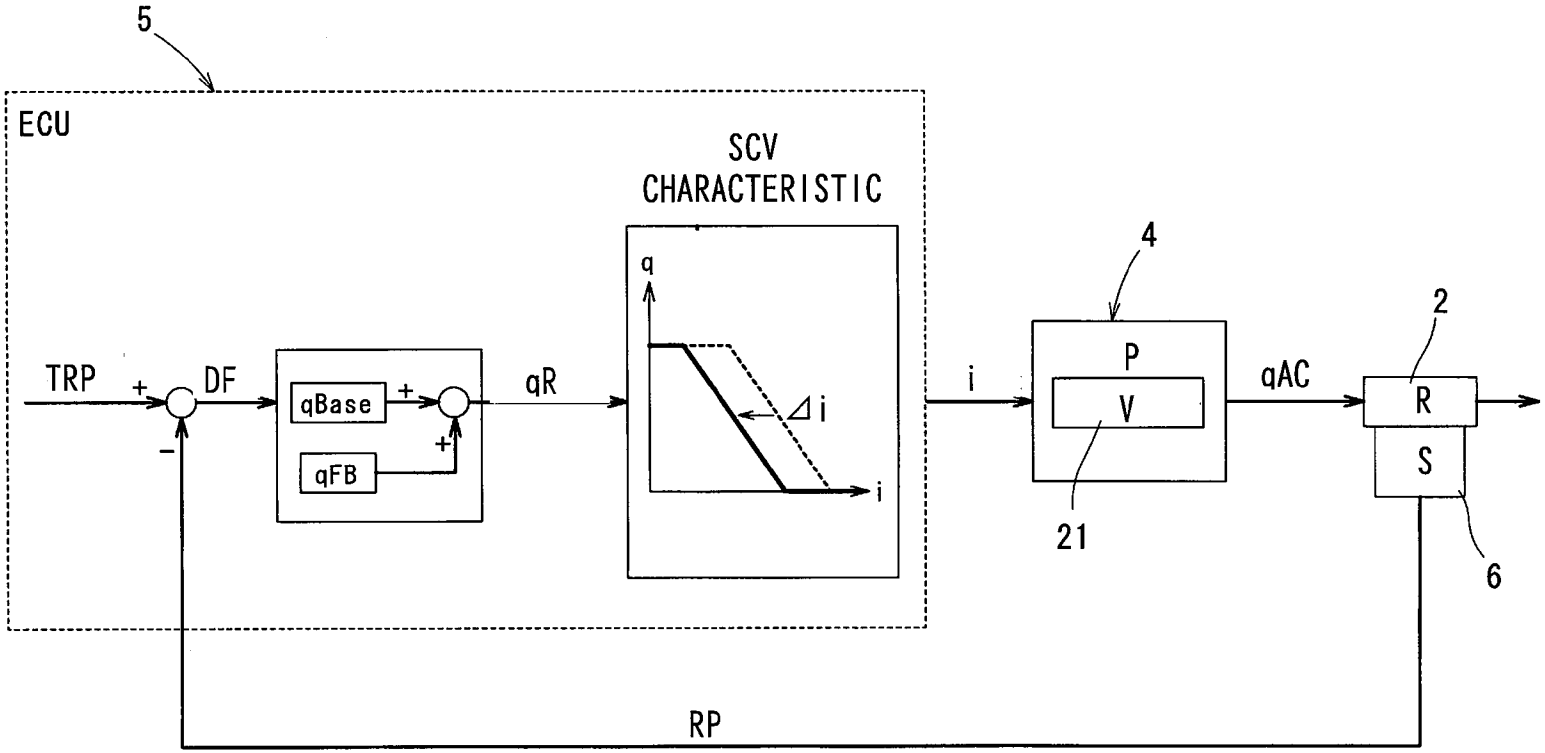
FIG. 5 is a characteristic drawing illustrating SCV characteristics.

The ECU 5 performs feedback control of the rail pressure by varying the amount of electric power "i". More specifically, the ECU 5 calculates a requesting discharge amount "qR" in order that the rail pressure "RP" substantially agree with a target rail pressure "TRP". In view of the SCV characteristic, the ECU 5 calculates a target electric power "Ti" based on the requesting discharge amount "qR", as shown in FIG. 5.

For example, the requesting discharge amount "qR" is obtained as a sum of a basic discharge amount "qBase" and a feedback discharge amount "qFB". The basic discharge amount "qBase" is determined unambiguously on the basis of a deflection "DF" between the detected rail pressure "DRP" and a target rail pressure "TRP". The feedback discharger amount "qFB" is obtained by executing a proportional-integral-differential (PID) control with respect to the deflection "DF". The ECU 5 obtains a duty ratio of energization to the coil 38 on the basis of the target electric power "Ti", and supplies an electric current to the coil 38 in accordance with the obtained duty ratio, so that the electric power "i" substantially agrees with the target electric power "Ti".

The starting mode of the fuel supply apparatus 1 is established in order to fill the common rail 2 reliably with fuel at the time of starting the internal combustion engine. Therefore, in the starting mode, in order to increase an actual discharge amount "qAC", the ECU 5 computes a new target electric power which is smaller than a formal target electric power "Ti" obtained based on the requesting discharge amount "qR" in view of the SCV characteristics. Therefore, in the start mode of the fuel supply apparatus 1, the final target electric power "FTi" is calculated by correcting the formal target electric power "Ti".

The common correction value "CV" is utilized when calculating the final target electric power "FTi" in the starting mode. For example, the common correction value "CV" is a subtraction value Δi which is subtracted from the formal target electric power "Ti". The common correction value "CV" is set to increase the actual discharge amount "qAC" and bring the rail pressure "RP" to substantially agree with the target rail pressure "TRP" at the time of starting the internal combustion engine even for an individual supply pump 4 which has a lowest discharge amount and shows a largest variation in discharge amount "q" among the individual supply pump 4 of the same type. The common correction value "CV" is shared among the same type supply pump 4, and the common correction value "CV" is stored in the ECU 5 of each vehicle as an identical value.

Furthermore, in the starting mode, the final target electric power "FTi" is calculated in a manner described below. For example, as illustrated in FIG. 4, when the requesting discharge amount "qR" is calculated as "q*", the final target electric power "FTi" is calculated as "i*" by applying "q*" to the master characteristics. Subsequently, by subtracting the subtraction value Δi from the electric power value "i*", the electric power value "i*−Δi" is calculated as the final target electric power "FTi". Consequently, the requesting discharge amount "qR" is practically increased by an amount Δq corresponding to the subtraction value Δi.

Also, in the starting mode, the relief valve 7 is feedback controlled in such a manner that the rail pressure "RP" agrees with the target rail pressure "TRP". In other words, in the starting mode, the rail pressure "RP" is controlled by adjusting both of the discharge amount "q" of the supply pump 4 and the relief amount "qRE" of the relief valve 7. Practically, the discharge amount "q" of the supply pump 4 is increased to a value larger than the value on the basis of the deflection "DF" of the rail pressure "RP". The relief amount "qRE" is adjusted on the basis of the deflection "DF" so that an increase in the rail pressure "RP" on the basis of the increase in the discharge amount "q" is suppressed.

In the start mode, the feedback amount "qFB" is calculated in calculating the formal target electric power "Ti". Also, a proportional term "P", an integral term "I", and a differential term "D" are respectively calculated by performing the PID control with respect to the deflection "DF" of the rail pressure "RP". Furthermore, since the start mode is sifted to an operation mode after starting of the internal combustion engine, various determinations and monitoring are performed based on the proportional term "P" and the integral term "I".

Specifically, in the start mode, a diminishing operation is started after the proportional term P becomes zero after the internal combustion engine is started. In the diminishing operation, the subtraction value Δi is decreased from the common correction value "CV" toward zero. The diminishing operation is mainly intended to reduce the amount of consumption of energy required for discharging fuel by the supply pump 4 after the start of the internal combustion engine. More specifically, the diminishing operation is mainly intended to reduce the actual discharge amount "qAC" of the supply pump 4 by closing the relief valve 7. When proportional term "P" is substantially zero, the operation of the supply pump 4 is stabilized after the start of the internal combustion engine.

In the start mode, subsequently, it is monitored whether an absolute value of the integral term "I" becomes larger than a predetermined threshold value ϵ after the diminishing operation is started. In the start mode, when the absolute value of the integral term "I" becomes larger than the threshold value ϵ, the diminishing operation is stopped, and the subtraction value Δi is fixed to a value obtained when the diminishing operation is stopped. The object of monitoring the integral term "I" is to avoid an event in which the control of the rail pressure "RP" by the supply pump 4 becomes unstable due to an excessive accumulation of the integral term "I".

In other words, when the subtraction value Δi is continuously decreased to move the relief valve 7 toward the closed position in a state in which the integral term "I" is excessively accumulated, the control of the rail pressure by the supply pump 4 may become unstable. Therefore, whether the integral term "I" is excessively accumulated is monitored after the start of the internal combustion engine. If the integral term "I" is excessively accumulated, the subtraction value Δi is fixed to a value obtained when the diminishing operation is stopped, and the movement of the relief valve 7 toward the closed position is stopped. In this operation, such an event that the control of the rail pressure by the pump unit becomes unstable due to an excessive accumulation of the integral term "I" is avoided.

[Operation]

An operation of the fuel supply apparatus 1 will be described based on a flowchart shown in FIG. 6 and a time chart shown in FIG. 7.

When a demand to start the internal combustion engine is generated by an ignition-on operation by a passenger, the ECU 5 operates the fuel supply apparatus 1 in the start mode. In other words, the ECU 5 calculates "i*−Δi" as the final target electric power "FTi", so that the actual discharge amount "qAC" of the supply pump 4 is increased. An initial value of Δi is the common correction value "CV". Simultaneously, the ECU 5 performs a feedback control of the relief valve 7 so that the rail pressure "RP" substantially agrees with the target rail pressure "TRP".

Accordingly, the common rail 2 is filled with the fuel. The fuel is accumulated and supplied to the combustion chamber through the fuel injector 3 for starting the internal combustion engine. The increase of the rail pressure "RP" according to the increase in the actual discharge amount "qAC" is suppressed by the operation of the relief valve 7.

Figure 6:
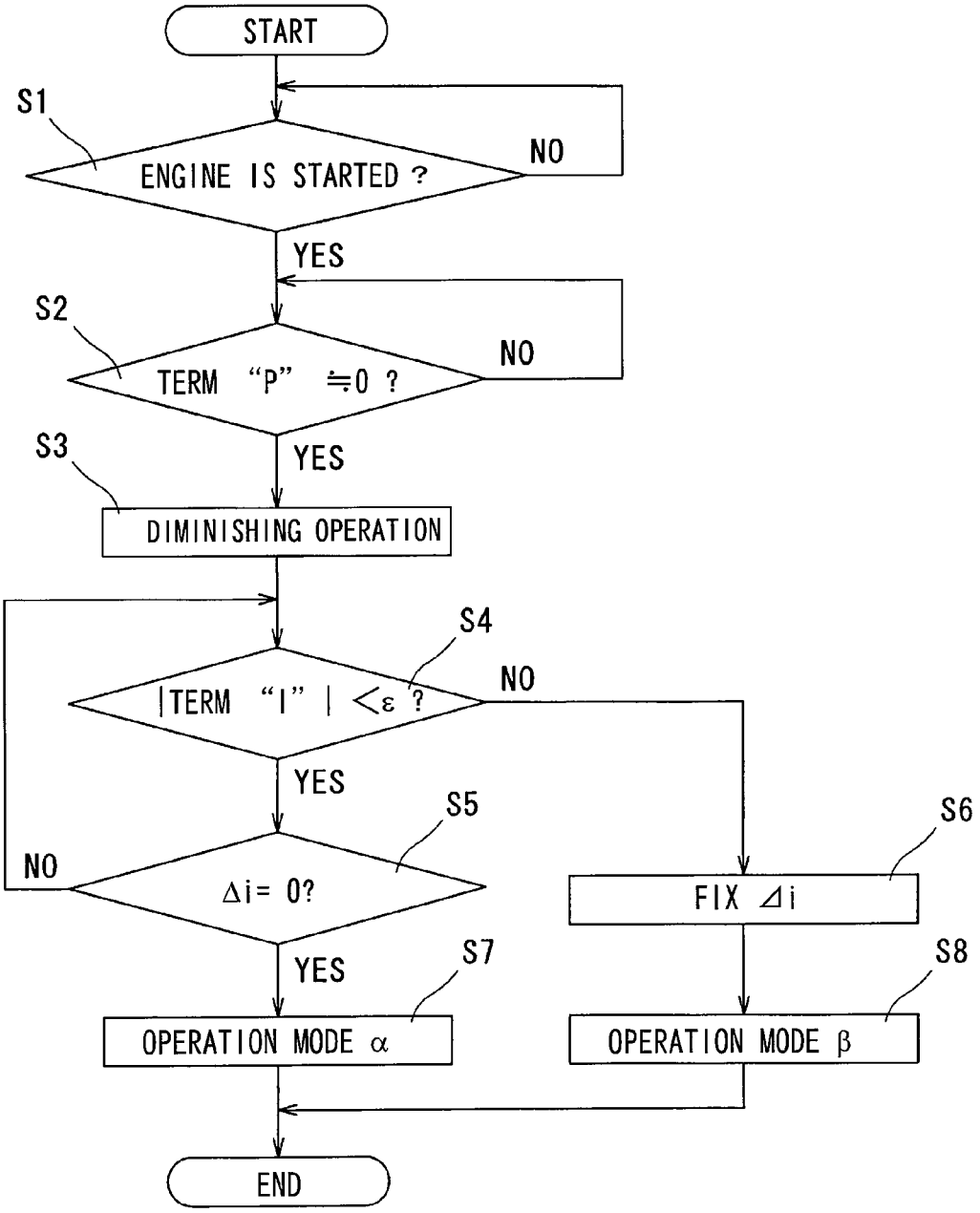
FIG. 6 is a flowchart illustrating a control process performed in a starting mode.

Furthermore, in the start mode, a control process illustrated in the flowchart in FIG. 6 is performed. The control process is performed for shifting the start mode to either one of operation modes α and β, which will be described later.

According to the flowchart of FIG. 6, it is determined whether the internal combustion engine is started at step S1. When the answer is YES at step S1, the procedure proceeds to step S2. When the answer is NO at step S1, the procedure is held at step S1.

Subsequently, it is determined whether the proportional term "P" is substantially zero at step S2. When the proportional term "P" is substantially matches zero, it is determined that the operation of the supply pump 4 is stabilized. Then, the procedure proceeds to step S3.

Figure 7:
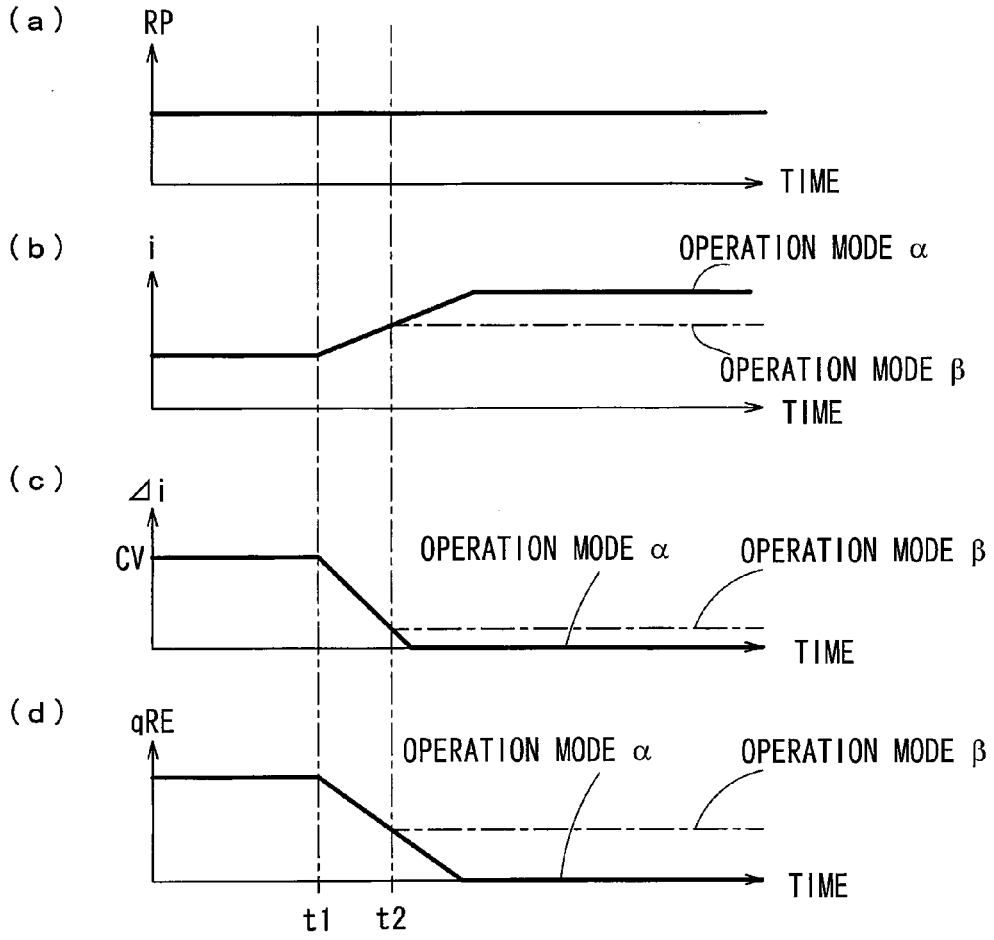
FIG. 7 is a time chart illustrating a rail pressure "RP", an amount of electric power "i" supplied to a suction control valve, a subtraction value Δi, and a relief fuel amount "qRE" by a relief valve.

The diminishing operation is started at step S3 (refer to time t1 in FIG. 7). Accordingly, the amount of electric power "i" starts increasing and, accordingly, the suction control valve 21 starts moving toward the closed position, whereby the actual discharge amount "qAC" starts decreasing. The rail pressure "RP" is not changed before and after the start of the diminishing operation. In the diminishing operation, the subtraction value Δi is decreased to zero in a pattern of a linear function with respect to an elapsed time, for example.

It is determined whether the absolute value of the integral term "I" is smaller than the predetermined threshold value ϵ at step S4. When the answer is YES at step S4, the procedure proceeds to step S5. When the answer is NO at step S4, the procedure proceeds to step S6.

It is determined whether the subtraction value Δi becomes zero at step S5. Accordingly, it is determined whether the diminishing operation is completed. When the answer is YES at step S5, the procedure proceeds to step S7. When the answer is NO, the procedure goes back to step S4.

The subtraction value Δi is fixed at step S6 (refer to time t2 in FIG. 7). Accordingly, the diminishing operation is stopped, the subtraction value Δi is fixed to a value smaller than the common correction value "CV" and larger than zero, and the amount of electric power "i" stops increasing. Accordingly, the actual discharge amount "qAC" stops decreasing and the relief valve 7 stops the movement toward the closed position at the same time. The rail pressure "RP" does not change before and after the stop of the diminishing operation. The subtraction value Δi is fixed at step S6, and the procedure proceeds to step S8.

At step S7, the mode is shifted to the operation mode α. Accordingly, the ECU 5 switches a mode of the control from the start mode to the operation mode α.

In the operation mode α, the feedback control of the rail pressure is performed by varying the amount of electric power "i" while maintaining the opening degree of the relief valve 7 at zero, and a target electric power "Ti" is set to "FTi" as a formal target vale. Therefore, in the operation mode α, the rail pressure is feedback controlled by varying the amount of electric power "i" without increasing the discharge amount "q".

The mode is shifted to an operation mode β at step S8. Accordingly, the ECU 5 switches the mode of the control from the start mode to the operation mode β.

In the operation mode β, feedback control of the rail pressure is performed by varying the amount of electric power "i" and the opening degree of the relief valve 7. The target electric power "Ti" is set to "i*−Δi". The subtraction value Δi is a value obtained when the diminishing operation is stopped, and is smaller than the common correction value "CV". Therefore, in the operation mode β, the discharge amount "q" is increased, and the relief fuel amount "qRE" is adjusted so that the increase in rail pressure "RP" due to the increase in discharge amount "q" is suppressed.

[Advantage of Embodiment]

According to the fuel supply apparatus 1, in the start mode, the final target electric power "FTi" is obtained by subtracting the subtraction value Δi from the formal final target electric power obtained from the SCV characteristics. Furthermore, the common correction value "CV" is set as a value which can increase the rail pressure to substantially agree with the target rail pressure. The actual discharge amount "qAC" is increased when the internal combustion engine is started even the individual shows the lowest limit in the variations of the discharge amount "q" among the individual supply pumps 4. The common correction value "CV" is shared among the individuals.

Accordingly, the fuel is filled reliably in the common rail 2 and is accumulated to bring the rail pressure "RP" to substantially agree with the target rail pressure "TRP" when the internal combustion engine is started even when the supply pump 4 is the lowest amount-of-discharge unit. Therefore, even though the supply pump 4 is the lowest amount-of-discharge unit, an amount of fuel injection required for starting the internal combustion engine is reliably injected and supplied to the combustion chamber.

With the configuration of the fuel supply apparatus 1 described above, even though the starting characteristics are not acquired for each of the individual supply pumps 4, the internal combustion engine can reliably be started.

The fuel supply apparatus 1 is provided with the relief valve 7 configured to release the fuel from the common rail 2. In the starting mode, a feedback control of the relief valve 7 is operated to bring the rail pressure "RP" to substantially agree with the target rail pressure "TRP".

Accordingly, the common rail 2 is prevented from being filled with fuel excessively and the rail pressure "RP" may be brought to substantially agree with the target rail pressure "TRP" stably even when the actual discharge amount "qAC" becomes excessive by using the common correction value "CV".

In the start mode, the proportional term "P" is calculated for bringing the rail pressure "RP" to substantially agree with match the target rail pressure "TRP". In addition, in the start mode, after the proportional term "P" becomes substantially zero after the start of the internal combustion engine, a diminishing operation is started for decreasing the subtraction value Δi from the common correction value "CV" toward zero.

Accordingly, after the control of the rail pressure is stabilized after the start of the internal combustion engine, the relief valve 7 is moved toward the closed position to reduce the actual discharge amount "qAC" of the supply pump 4, so that the amount of consumption of energy in the supply pump 4 may be reduced.

In the start mode, the integral term "I" for bringing the rail pressure "RP" to substantially agree with the target rail pressure "TRP" by discharging fuel by the supply pump 4 is calculated in calculating the formal target value of the amount of electric power "i".

In the start mode, subsequently, whether or not an absolute value of the integral term "I" becomes larger than the threshold values is monitored after the diminishing operation has started. In the start mode, when the absolute value of the integral term "I" becomes larger than the threshold value ϵ, the diminishing operation is stopped, and the subtraction value Δi is fixed to a value obtained when the diminishing operation is stopped.

Accordingly, such an event that the control of the rail pressure by the supply pump 4 becomes unstable due to an excessive accumulation of the integral term "I" can be avoided after the start of the internal combustion engine.

[Modifications]

The mode of the fuel supply apparatus 1 is not limited to the example, and various modifications are conceivable.

For example, a specified value may be added to the requesting discharge amount "qR" as the amount of correction.

According to the fuel supply apparatus 1 of the above embodiment, the suction control valve 21 is a normally opened valve. However, a normally closed valve may be employed as the suction control valve 21. In this case, the final target electric power "FTi" in the start mode is larger than the formal target electric power "Ti", and the amount of correction is added to the formal target value.

Furthermore, according to the fuel supply apparatus 1 of the above embodiment, in the start mode, the integral term "I" for bringing the rail pressure "RP" to substantially match the target rail pressure "TRP" is calculated, the threshold value ϵ is set for the absolute value of the integral term "I", and the diminishing operation is stopped when the excessive accumulation of the integral term "I" occurs. However, the start mode may be set to operate the opening degree of the relief valve 7 after the start of the internal combustion engine so as to prevent the absolute value of the integral term "I" from exceeding the threshold value ϵ. In other words, the start mode may be set to perform feedback control of the absolute value of the integral term "I" by operating the opening degree of the relief valve 7.

What is claimed is:

1. A fuel supply apparatus supplying a fuel to an internal combustion engine through an accumulator in which the fuel is accumulated at a high pressure, comprising:

a pump unit having a high-pressure pump and an amount adjusting portion; and a control unit controlling the pump unit; and a relief valve releasing the fuel from the accumulator in accordance with an opening degree of the relief valve, wherein the high-pressure pump suctions the fuel, pressurizes the fuel and discharges the fuel to the accumulator, the amount adjusting portion adjusts an amount of the fuel which is suctioned by the high-pressure pump and adjusts the amount of the fuel which is discharged by the high-pressure pump in accordance with an amount of an electric power supplied to the amount adjusting portion, the control unit stores an control characteristic of the amount adjusting portion, which shows a correlation between the amount of electric power and a discharge amount of the high-pressure pump, the control unit calculates a requesting discharge amount for bringing the fuel pressure in the accumulator to substantially agree with a target pressure, the control unit calculates a target electric power based on the requesting discharge amount in view of the control characteristics, the control unit corrects the target electric power in such a manner as to increase an actual discharge amount of the high-pressure pump, the control unit defines a start mode in which the target electric power obtained by applying the requesting discharge amount to the control characteristics is calculated as a final target electric power so that the actual discharge amount is increased, the final target electric power is computed by using of a common correction value so that the fuel pressure in the accumulator substantially agrees with the target fuel pressure even if the pump unit individually shows a largest variation of the discharge amount, wherein the common correction value is shared among individual supply pump, and in the start mode, the relief valve and the amount adjusting portion are controlled in such a manner that the fuel pressure in the accumulator substantially agrees with the target fuel pressure.

2. The fuel supply apparatus according to claim 1, wherein in the start mode, the control unit computes an proportional term "P" with respect to a deflection between a detected rail pressure and a target rail pressure in order that the fuel pressure in the accumulator substantially agrees with a target fuel pressure, and after the internal combustion is started and the proportional term "P" becomes substantially zero, a diminishing operation is started for decreasing a correction value from the common correction value toward zero.

3. The fuel supply apparatus according to claim 1, wherein in the start mode, the control unit computes an integral term "I" with respect to a deflection between a detected rail pressure and a target rail pressure in order that the fuel pressure in the accumulator substantially agrees with a target fuel pressure, and after the internal combustion is started, a diminishing operation is started for decreasing a correction value from the common correction value toward zero, after the diminishing operation is started, the control unit monitors whether an absolute value of the term "I" becomes larger than a predetermined threshold value, and when the absolute value of the integral term "I" becomes larger than the predetermined threshold value, the diminishing operation is stopped and a correction value is fixed to a value obtained when the diminishing operation is stopped.

4. The fuel supply apparatus according to claim 3, wherein in the start mode, the control unit controls the relief valve so that the absolute value of the integral term "I" does not exceed the predetermined threshold value after the start of the internal combustion engine.

* * * * *